US006287155B1

(12) United States Patent
Yakovich

(10) Patent No.: US 6,287,155 B1
(45) Date of Patent: Sep. 11, 2001

(54) BATTERY TERMINAL CONNECTOR

(76) Inventor: Michael P. Yakovich, P.O. Box 1318, Skagway, AK (US) 99840

( * ) Notice: Subject to any disclaimer, the term of this patent is extended or adjusted under 35 U.S.C. 154(b) by 0 days.

(21) Appl. No.: 09/653,306

(22) Filed: Sep. 1, 2000

(51) Int. Cl.[7] ..... H01R 4/50
(52) U.S. Cl. ..... 439/772; 439/754; 439/773
(58) Field of Search ..... 439/772, 773, 439/756, 759, 769, 761, 752

(56) References Cited

U.S. PATENT DOCUMENTS

| | | | | |
|---|---|---|---|---|
| D. 286,767 | | 11/1986 | Eriksson . | |
| 2,602,105 | | 7/1952 | Welch et al. . | |
| 3,008,114 | * | 11/1961 | Adkins | 439/759 X |
| 3,521,223 | * | 7/1970 | Martinez | 439/726 |
| 3,568,139 | | 3/1971 | Lainer . | |
| 3,944,318 | | 3/1976 | Backes . | |
| 4,256,361 | * | 3/1981 | Bell | 439/759 |
| 4,385,796 | * | 5/1983 | Eriksson | 439/772 |
| 4,555,159 | * | 11/1985 | Chartrain et al. | 439/773 |
| 5,254,020 | * | 10/1993 | Pbligar | 439/761 |
| 5,556,309 | * | 9/1996 | Sharpe et al. | 439/759 |

* cited by examiner

*Primary Examiner*—Brian Sircus
*Assistant Examiner*—Son V. Nguyen

(57) ABSTRACT

A battery terminal connector for providing a better and more secure manner of connecting battery cables to batteries. The battery terminal connector includes a support member having a main portion and a jaw portion integrally attached to the main portion; and also includes a jaw member being pivotally attached to the support member and being opposed to the jaw portion of the support member; and further includes cable fastening members attached to the support member for clamping the battery terminal connector to a battery cable; and also includes a locking assembly for locking the jaw member to the jaw portion of the support member.

16 Claims, 4 Drawing Sheets

BATTERY TERMINAL CONNECTOR

BACKGROUND OF THE INVENTION

1. Field of the Invention

The present invention relates to a battery terminal fastener and more particularly pertains to a new battery terminal connector for providing a better and more secure manner of connecting battery cables to batteries.

2. Description of the Prior Art

The use of a battery terminal fastener is known in the prior art. More specifically, a battery terminal fastener heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,256,361; U.S. Pat. No. 3,568,139; U.S. Pat. No. 3,944,318; U.S. Pat. No. 2,602,105; U.S. Pat. No. 5,556,309; and U.S. Pat. No. Des. 286,767.

While these devices fulfill their respective, particular objectives and requirements, the aforementioned patents do not disclose a new battery terminal connector. The inventive device includes a support member having a main portion and a jaw portion integrally attached to the main portion; and also includes a jaw member being pivotally attached to the support member and being opposed to the jaw portion of the support member; and further includes cable fastening members attached to the support member for clamping the battery terminal connector to a battery cable; and also includes a locking assembly for locking the jaw member to the jaw portion of the support member.

In these respects, the battery terminal connector according to the present invention substantially departs from the conventional concepts and designs of the prior art, and in so doing provides an apparatus primarily developed for the purpose of providing a better and more secure manner of connecting battery cables to batteries.

SUMMARY OF THE INVENTION

In view of the foregoing disadvantages inherent in the known types of battery terminal fastener now present in the prior art, the present invention provides a new battery terminal connector construction wherein the same can be utilized for providing a better and more secure manner of connecting battery cables to batteries.

The general purpose of the present invention, which will be described subsequently in greater detail, is to provide a new battery terminal connector which has many of the advantages of the battery terminal fastener mentioned heretofore and many novel features that result in a new battery terminal connector which is not anticipated, rendered obvious, suggested, or even implied by any of the prior art battery terminal fastener, either alone or in any combination thereof.

To attain this, the present invention generally comprises a support member having a main portion and a jaw portion integrally attached to the main portion; and also includes a jaw member being pivotally attached to the support member and being opposed to the jaw portion of the support member; and further includes cable fastening members attached to the support member for clamping the battery terminal connector to a battery cable; and also includes a locking assembly for locking the jaw member to the jaw portion of the support member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new battery terminal connector which has many of the advantages of the battery terminal fastener mentioned heretofore and many novel features that result in a new battery terminal connector which is not anticipated, rendered obvious, suggested, or even implied by any of the prior art battery terminal fastener, either alone or in any combination thereof.

It is another object of the present invention to provide a new battery terminal connector which may be easily and efficiently manufactured and marketed.

It is a further object of the present invention to provide a new battery terminal connector which is of a durable and reliable construction.

An even further object of the present invention is to provide a new battery terminal connector which is susceptible of a low cost of manufacture with regard to both materials and labor, and which accordingly is then susceptible of low prices of sale to the consuming public, thereby making such battery terminal connector economically available to the buying public.

Still yet another object of the present invention is to provide a new battery terminal connector which provides in the apparatuses and methods of the prior art some of the advantages thereof, while simultaneously overcoming some of the disadvantages normally associated therewith.

Still another object of the present invention is to provide a new battery terminal connector for providing a better and more secure manner of connecting battery cables to batteries.

Yet another object of the present invention is to provide a new battery terminal connector which includes a support member having a main portion and a jaw portion integrally attached to the main portion; and also includes a jaw member being pivotally attached to the support member and being opposed to the jaw portion of the support member; and further includes cable fastening members attached to the support member for clamping the battery terminal connector to a battery cable; and also includes a locking assembly for locking the jaw member to the jaw portion of the support member.

Still yet another object of the present invention is to provide a new battery terminal connector that eliminates having to use a wrench to tighten a battery terminal connector to the battery terminal.

Even still another object of the present invention is to provide a new battery terminal connector that eliminates the problems associated with the bolts of conventional battery terminal connectors from becoming corroded and hard to remove.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
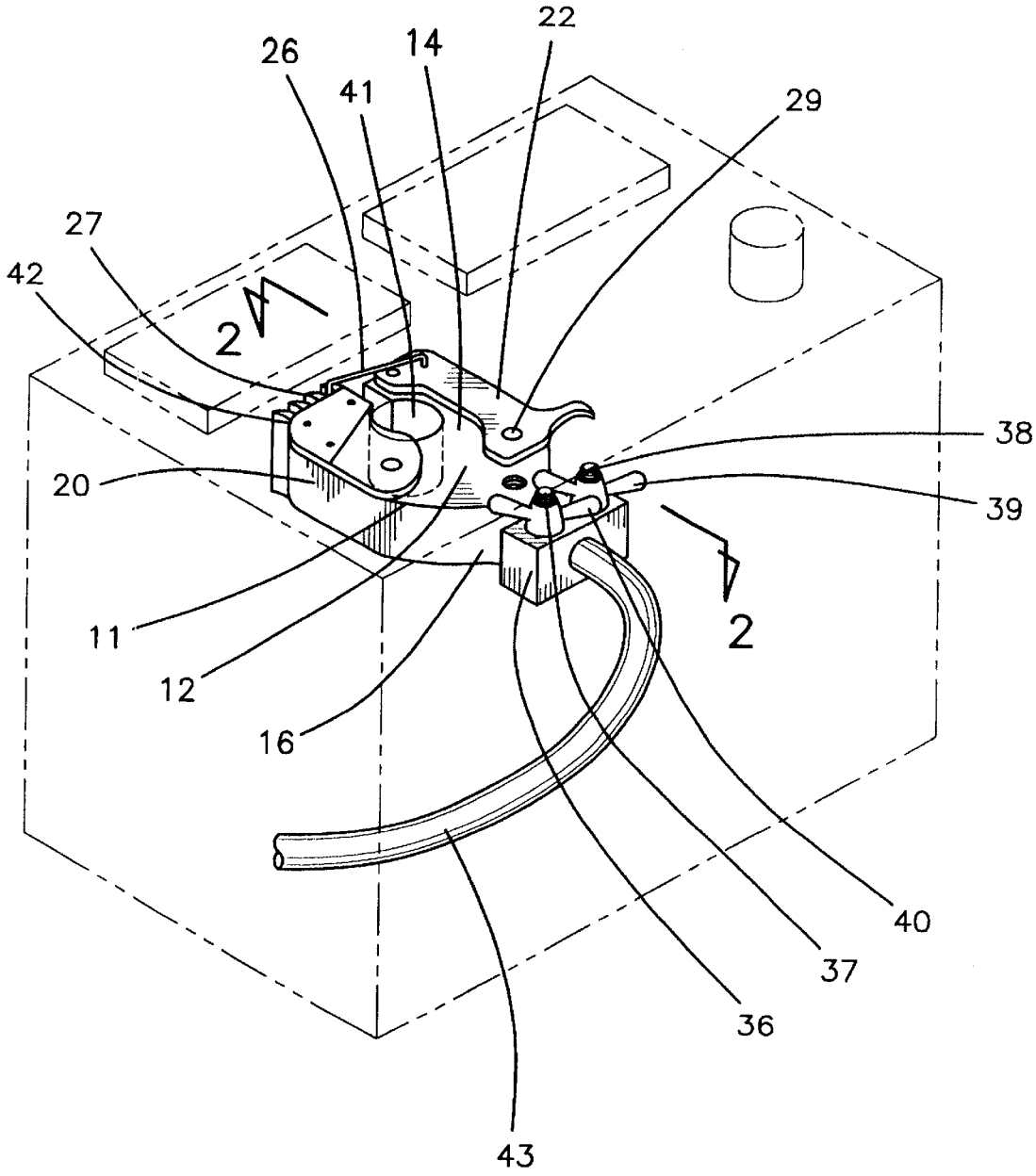
FIG. 1 is a perspective view of a new battery terminal connector according to the present invention and shown in use.
Figure 2:
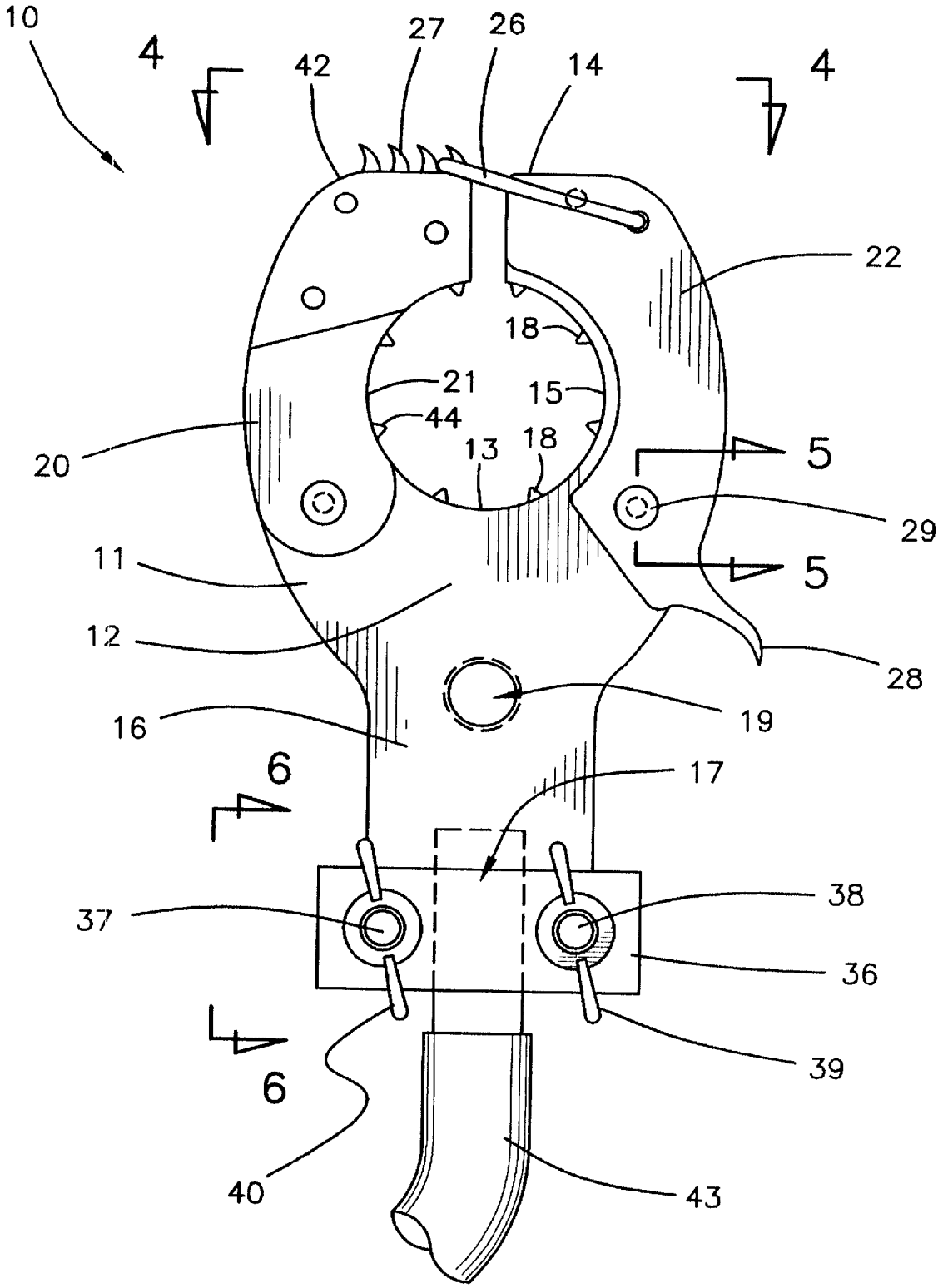
FIG. 2 is a side elevational view of the present invention.
Figure 3:
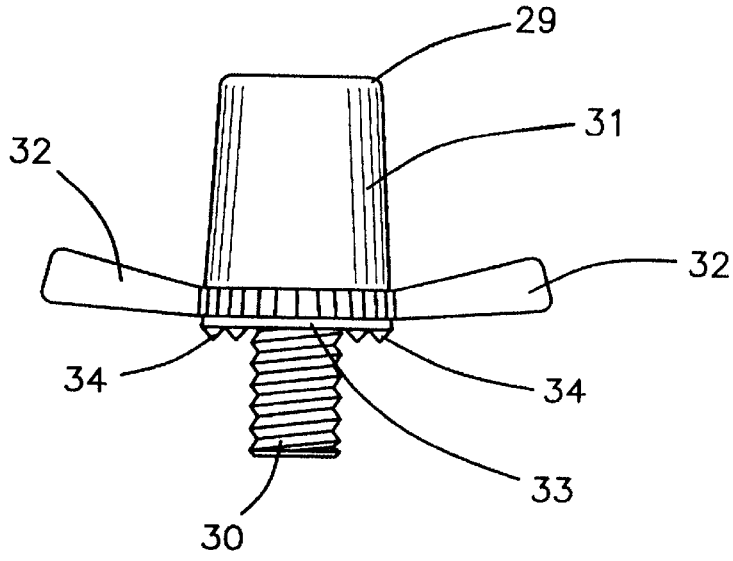
FIG. 3 is a detailed side elevational view of the fastening member of the present invention.
Figure 4:
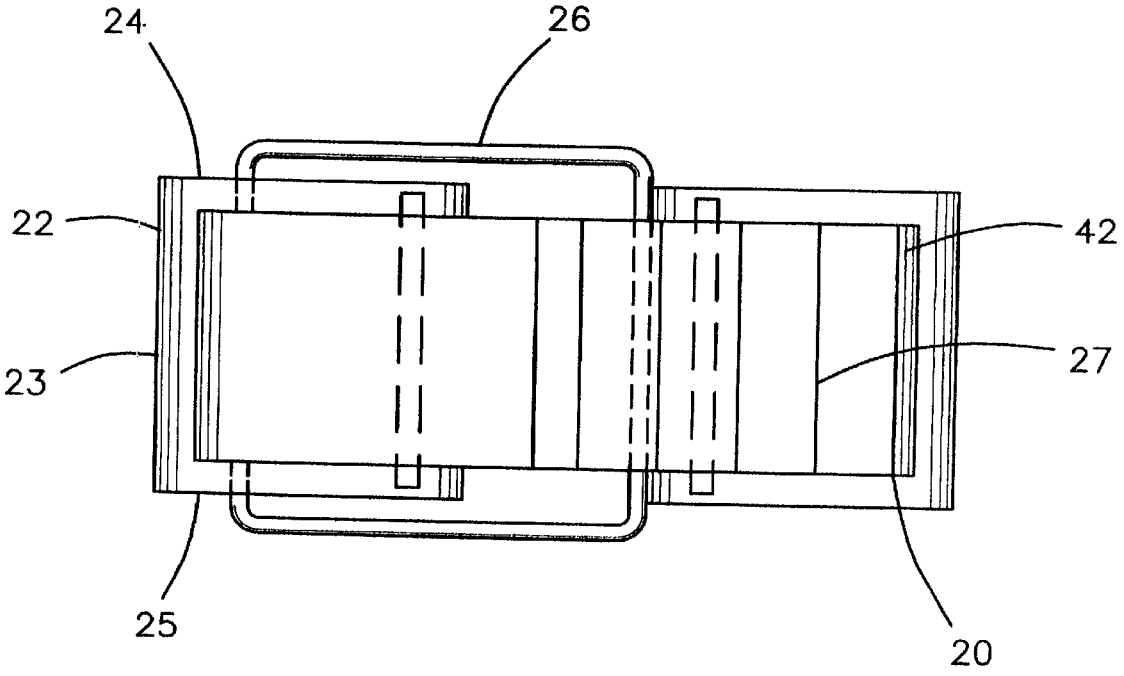
FIG. 4 is a front elevational view of the present invention.
Figure 5:
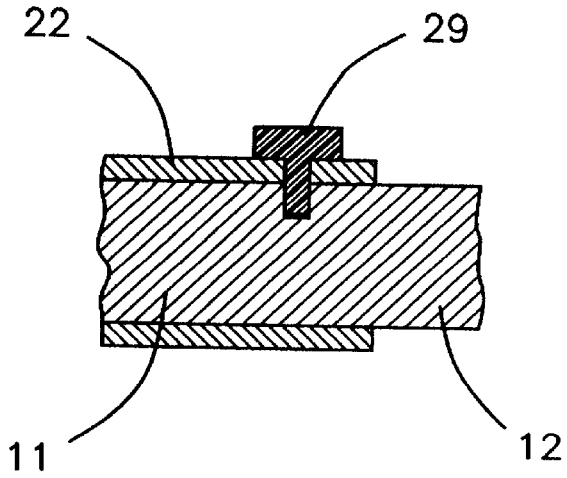
FIG. 5 is a detailed cross-sectional view of the hinge member being fastened to the support member with the fastening member of the present invention.
Figure 6:
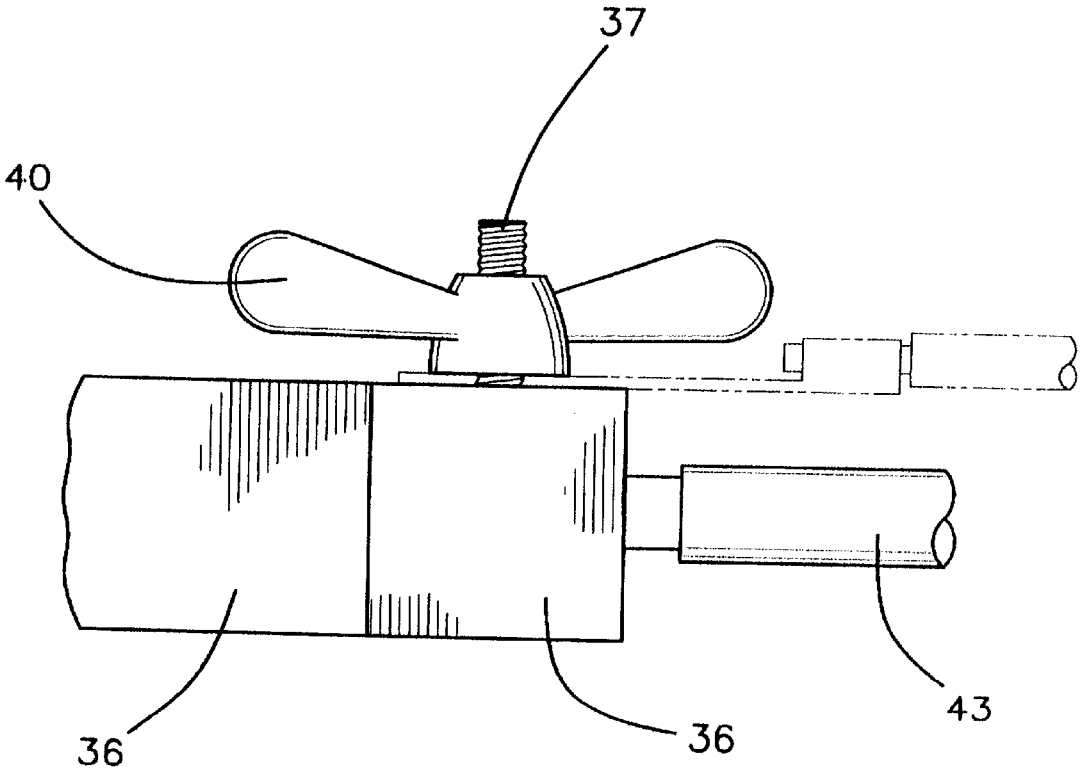
FIG. 6 is a detailed side elevational view of the cable fastening members of the present invention.

With reference now to the drawings, and in particular to FIGS. 1 through 6 thereof, a new battery terminal connector embodying the principles and concepts of the present invention and generally designated by the reference numeral 10 will be described.

As best illustrated in FIGS. 1 through 6, the battery terminal connector 10 generally comprises a support member 11 having a main portion 12 and a jaw portion 14 integrally attached to the main portion 12. The main portion 12 includes an arcuate front edge 13, and the jaw portion 14 includes an arcuate side edge 15 which is essentially continuous of the front edge 13 of the main portion 12. The support member 11 has a plurality of first teeth 18 conventionally disposed along the front and side edges 13,15 for gripping about a battery terminal 41. The support member 11 further includes an extended portion 16 integrally extending from a back end of the main portion 12 thereof with the extended portion 16 having a hole 19 extending therethrough for receiving a post.

A jaw member 20 is pivotally and conventionally attached to the support member 11 and is opposed to the jaw portion 14 of the support member 11. The jaw member 20 has an end which is pivotally attached to the main portion 12 of the support member 11 and has an arcuate side edge 21 which faces the arcuate side edge 15 of the jaw portion 14 and which has a plurality of second teeth 44 conventionally disposed therealong and being in alignment with the first teeth 18. The extended portion 16 has a slot 17 extending in an end thereof for receiving a portion of a battery cable 43.

Cable fastening members 36–40 are conventionally attached to the support member 11 for clamping the battery terminal connector to the battery cable 43. The cable fastening members 36–40 include plate-like members 36, threaded members 37,38 extending through the plate-like members 36, and winged nuts 39,40 being threaded upon the threaded members 37,38 for securely fastening the plate-like members 36 about the battery cable 43.

A means for locking the jaw member 20 to the jaw portion 14 of the support member 11 includes a hinge member 22 being pivotally and conventionally attached to the support member 11, and also includes a lever 26 being pivotally and conventionally attached to the hinge member 22, and further includes a plurality of teeth members 27 being securely and conventionally disposed along a front end 42 of the jaw member 20, and also includes a fastening member 29 for fastening the hinge member 22 to the main portion 12 of the support member 11, and further includes a handle member 28 securely and integrally attached to the hinge member 22 near an end thereof for moving the hinge member 22 relative to the support member 11. The hinge member 22 includes a main wall 23 and side walls 24,25 extending from longitudinal side edges of the main wall 23 and being spaced apart and forming a slot therebetween with the slot being adapted to receive the jaw portion 14 of the support member 11. The lever 26 is a ring member and is adapted to engage between the teeth members 27 for securely fastening and locking the jaw member 20 and the jaw portion 14 about a battery terminal 41. The fastening member 29 includes a threaded stem portion 30 which extends through a hole in the hinge member 22 and which is threaded into the main portion 12 of the support member 11, and also includes a head portion 31 having winged portions 32 extending outwardly thereof with the head portion 31 further having a bottom side 33 and a plurality of nib-like teeth members 34 conventionally disposed upon the bottom side 33 for gripping to the hinge member 22.

In use, the user clamps the plate-like members 36 about the end of the battery cable 43 using the threaded members 37,38 and the winged nuts 39,40, and then opens the jaw member 20 relative to the jaw portion 14 and places the support member 11 and the jaw member 20 about the battery terminal 41, and then locks the jaw member 20 to the jaw portion 14 with the lever 26 and the hinge member 22 which is securely fastened to the main portion 12 of the support member 11 with the fastening member 29.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A battery terminal connector comprising:

a support member having a main portion and a jaw portion integrally attached to said main portion;

a jaw member being pivotally attached to said support member;

cable fastening members attached to said support member for clamping said battery terminal connector to a battery cable; and a means for locking said jaw member to said jaw portion of said support member;

wherein said main portion includes an arcuate front edge, and said jaw portion includes an arcuate side edge which is essentially continuous of said front edge of said main portion, said support member having a plurality of first teeth disposed along said front and side edges for gripping about a battery terminal;

wherein said support member further includes an extended portion extending from a back end of said main portion thereof, said extended portion having a hole extending therethrough for receiving a post;

wherein said jaw member has an end which is pivotally attached to said main portion of said support member and has an arcuate side edge which faces said arcuate side edge of said jaw portion and which has a plurality of second teeth disposed therealong and being in alignment with said first teeth; and wherein said means for locking said jaw member to said jaw portion includes a hinge member being pivotally attached to said support member, and also includes a lever being pivotally attached to said hinge member, and further includes a plurality of teeth members being securely disposed along a front end of said jaw member, and also including a fastening member for fastening said hinge member to said main portion of said support member, and further including a handle member securely attached to said hinge member near an end thereof for moving said hinge member relative to said support member.

2. The battery terminal connector as described in claim 1, wherein said hinge member includes a main wall and side walls extending from longitudinal side edges of said main wall, said side walls being spaced apart to form a slot therebetween for receiving said jaw portion of said support member.

3. The battery terminal connector as described in claim 1, wherein said lever is a ring member and is adapted to engage between said teeth members for securely fastening and locking said jaw member and said jaw portion about a battery terminal.

4. The battery terminal connector as described in claim 1, wherein said extended portion has a slot extending in an end thereof for receiving a portion of the battery cable.

5. The battery terminal connector as described in claim 1, wherein said fastening member includes a threaded stem portion which extends through a hole in said hinge member and which is threaded into said main portion of said support member, and also includes a head portion having winged portions extending outwardly thereof, said head portion further having a bottom side and a plurality of nib-like teeth members disposed upon said bottom side for gripping to said hinge member.

6. The battery terminal connector as described in claim 1, wherein said cable fastening members include plate-like members, threaded members extending through said plate-like members, and winged nuts being threaded upon said threaded members for securely fastening said plate-like members about the battery cable.

7. A battery terminal connector comprising:

a support member having a main portion and a jaw portion integrally attached to said main portion, said main portion including an arcuate front edge, and said jaw portion including an arcuate side edge which is essentially continuous of said front edge of said main portion, said support member having a plurality of first teeth disposed along said front and side edges for gripping about a battery terminal, said support member further including an extended portion extending from a back end of said main portion thereof, said extended portion having a hole extending therethrough for receiving a post;

a jaw member being pivotally attached to said support member, said jaw member having an end which is pivotally attached to said main portion of said support member and having an arcuate side edge which faces said arcuate side edge of said jaw portion and which has a plurality of second teeth disposed therealong and being in alignment with said first teeth, said extended portion having a slot extending in an end thereof for receiving a portion of a battery cable;

cable fastening members attached to said support member for clamping said battery terminal connector to the battery cable, said cable fastening members include plate-like members, threaded members extending through said plate-like members, and winged nuts being threaded upon said threaded members for securely fastening said plate-like members about the battery cable; and a means for locking said jaw member to said jaw portion of said support member including a hinge member being pivotally attached to said support member, and also including a lever being pivotally attached to said hinge member, and further including a plurality of teeth members being securely disposed along a front end of said jaw member, and also including a fastening member for fastening said hinge member to said main portion of said support member, and further including a handle member securely attached to said hinge member near an end thereof for moving said hinge member relative to said support member, said hinge member including a main wall and side walls extending from longitudinal side edges of said main wall, said side walls being spaced apart to form a slot therebetween for receiving said jaw portion of said support member, said lever being a ring member and being adapted to engage between said teeth members for securely fastening and locking said jaw member and said jaw portion about a battery terminal, said fastening member including a threaded stem portion which extends through a hole in said hinge member and which is threaded into said main portion of said support member, and also including a head portion having winged portions extending outwardly thereof, said head portion further having a bottom side and a plurality of nib-like teeth members disposed upon said bottom side for gripping to said hinge member.

8. A battery terminal connector comprising:

a support member having a main portion and a jaw portion mounted on said main portion;

a jaw member being pivotally mounted on said support member;

cable fastening members mounted on said support member for clamping said battery terminal connector to a battery cable; and a means for locking said jaw member to said jaw portion of said support member, said means for locking said jaw member to said jaw portion including a hinge member being pivotally attached to said support member, a lever being pivotally attached to said hinge member, a plurality of teeth members being positioned along a front end of said jaw member, and a fastening member for fastening said hinge member to said main portion of said support member, and a handle member being attached to said hinge member for moving said hinge member relative to said support member.

9. The battery terminal connector as described in claim 8, wherein said main portion includes an arcuate front edge, and said jaw portion includes an arcuate side edge which is essentially continuous of said front edge of said main portion, said support member having a plurality of first teeth disposed along said front and side edges for gripping about a battery terminal.

10. The battery terminal connector as described in claim 8, wherein said support member further includes an extended portion extending from a back end of said main portion thereof, said extended portion having a hole extending therethrough for receiving a post.

11. The battery terminal connector as described in claim 8, wherein said jaw member has an end which is pivotally attached to said main portion of said support member and has an arcuate side edge which faces said arcuate side edge of said jaw portion and which has a plurality of second teeth disposed therealong and being in alignment with said first teeth.

12. The battery terminal connector as described in claim 8, wherein said hinge member includes a main wall and side walls extending from longitudinal side edges of said main wall, said side walls being spaced apart to form a slot therebetween for receiving said jaw portion of said support member.

13. The battery terminal connector as described in claim 8, wherein said lever is a ring member and is adapted to engage between said teeth members for securely fastening and locking said jaw member and said jaw portion about a battery terminal.

14. The battery terminal connector as described in claim 8, wherein said extended portion has a slot extending in an end thereof for receiving a portion of the battery cable.

15. The battery terminal connector as described in claim 8, wherein said fastening member includes a threaded stem portion which extends through a hole in said hinge member and which is threaded into said main portion of said support member, and also includes a head portion having winged portions extending outwardly thereof, said head portion further having a bottom side and a plurality of nib-like teeth members disposed upon said bottom side for gripping to said hinge member.

16. The battery terminal connector as described in claim 8, wherein said cable fastening members include plate-like members, threaded members extending through said plate-like members, and winged nuts being threaded upon said threaded members for securely fastening said plate-like members about the battery cable.

* * * * *